US008844453B2

(12) United States Patent
Kondou

(10) Patent No.: US 8,844,453 B2
(45) Date of Patent: Sep. 30, 2014

(54) SEWING MACHINE

(75) Inventor: Tetsurou Kondou, Tajimi (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 701 days.

(21) Appl. No.: 13/089,712

(22) Filed: Apr. 19, 2011

(65) Prior Publication Data

US 2011/0253021 A1 Oct. 20, 2011

(30) Foreign Application Priority Data

Apr. 19, 2010 (JP) ..... 2010-096188

(51) Int. Cl.
*D05B 35/06* (2006.01)
*D05B 37/04* (2006.01)
*D05C 7/08* (2006.01)

(52) U.S. Cl.
CPC ..... *D05B 35/06* (2013.01); *D05B 37/04* (2013.01); *D05C 7/08* (2013.01)
USPC ..... 112/114; 112/470.33; 112/128; 112/129

(58) Field of Classification Search
CPC ..... D05B 3/12; D05B 3/22; D05B 37/04; D05B 37/063; D05B 3/04; D05B 35/06; D05C 7/08
USPC ..... 112/63, 121.15, 131, 113, 121.11, 322, 112/114, 128, 129, 470.21, 470.28, 470.33, 112/152
See application file for complete search history.

(56) References Cited

U.S. PATENT DOCUMENTS 797,308 A * 8/1905 Nassberg ..... 112/99
1,356,762 A * 10/1920 Groebli ..... 112/99
1,607,532 A * 11/1926 Halberg ..... 112/152
4,258,637 A * 3/1981 Hannemann ..... 112/470.31

(Continued)

FOREIGN PATENT DOCUMENTS

JP 62-240094 A 10/1987
JP 2007-068829 A 3/2007
WO 2007/128364 A1 11/2007

OTHER PUBLICATIONS

Japanese Office Action for corresponding JP 2010-096188, mail date Feb. 25, 2014. English translation provided.

*Primary Examiner* — Danny Worrell
(74) *Attorney, Agent, or Firm* — Rossi, Kimms & McDowell LLP

(57) ABSTRACT

A guide is mounted to a rotary member which is freely rotatable about the axis of a needle bar, and guides a sewing material to a needle drop position of the sewing needle. A cutter device is mounted to a side of the rotary member opposed to the guide in such a manner that the cutter device is rotatable together with the rotary member for cutting the sewing material, having been paid out from the guide, at a predetermined cutting position. A retention mechanism is incorporated in the cutter device for retaining an end portion of the sewing material, at a position closer to the guide than the predetermined cutting position and in interlocked relation to cutting, by the cutter device, of the sewing material. Thus, upon restart of sewing of the sewing material, the retention mechanism retains an end portion of the sewing material.

9 Claims, 8 Drawing Sheets

(56) References Cited

U.S. PATENT DOCUMENTS

| | | | | | |
|---|---|---|---|---|---|
| 4,462,321 | A * | 7/1984 | Mall et al. | ..... | 112/470.28 |
| 4,813,361 | A * | 3/1989 | Yunoki | ..... | 112/104 |
| 5,029,543 | A * | 7/1991 | Trojan | ..... | 112/152 |
| 5,277,139 | A * | 1/1994 | Honeycutt | ..... | 112/470.08 |
| 5,566,633 | A * | 10/1996 | Wesstrom | ..... | 112/470.03 |
| 7,370,592 | B2 * | 5/2008 | Tajima et al. | ..... | 112/220 |
| 2007/0062427 | A1 | 3/2007 | Kondo | | |
| 2009/0235854 | A1 | 9/2009 | Heinrich et al. | | |

* cited by examiner

SEWING MACHINE

BACKGROUND

The present invention relates generally to sewing machines of a type which sews an elongated sewing material, such as a tape or cord, onto a sewing workpiece, such as a fabric, through lock stitching.

Heretofore, there have been known sewing machines of a type which includes a vertically driven needle bar, a sewing needle fixed to the lower end of the needle bar, a rotary member mounted concentrically with the needle bar and freely rotatable about the axis of the needle bar, and a guide fixed to the rotary member for guiding an elongated sewing material to a needle drop position of the sewing needle. The sewing machines of this type operate to sew the sewing material onto a sewing workpiece (fabric) through lock stitching while controlling the rotation of the rotary member in accordance with a moving direction of the fabric based on embroidery data and appropriately adjusting the orientation of the guide to optimize the direction in which the sewing material is guided to the needle drop position of the sewing needle.

When sewing the sewing material on the sewing machines of this type, there is a need to pull out in advance a certain length of the sewing material from the guide so that the sewing material can be reliably sewn at a predetermined sewing start position or point of the sewing material. Therefore, it has been customary for a human operator to pull out in advance a certain length of the sewing material from the guide so that sewing is started at a portion of the sewing material following the pulled-out portion. Upon completion of sewing of the sewing material, the human operator cuts the sewing material near a sewing end position or point of the sewing material, but also cuts off, prior to the start of next sewing, the relatively long previously-pulled-out portion preceding the sewing start point.

Some of the conventionally-known sewing machines of the aforementioned type are provided with a cutter device for cutting the sewing material with a view to reducing a burden on the human operator cutting the sewing material. International Patent Application Publication WO 2007-128364 (hereinafter referred to as "patent literature 1"), for example, discloses a sewing machine which includes a sewing-material cutter device vertically movable relative to the rotary member and rotatable about the axis of the needle bar together with the rotary member. The sewing machine also includes a presser foot member vertically movable, in synchronism with vertical movement of the needle bar, for pressing the sewing workpiece (fabric) from above as the presser foot member descends. Upon completion of sewing, the presser foot member evacuates upwardly to an evacuation position. The cutter device ascends or descends in interlocked relation to the descending or ascending movement of the presser foot member. Namely, the cutter device descends once the presser foot member ascends to the evacuation position, and ascends once the presser foot member descends to from the upper evacuated poison to its predetermined sewing operating position.

The cutter device includes a cutting blade that pivots in response to the ascending or descending movement of the cutter device, and a fixed blade that cuts the sewing material in conjunction with the cutting blade. As the cutter device descends, the cutting blade pivots away from the fixed blade. As the cutter device ascends, the cutting blade pivots toward the fixed blade to cut the sewing material in conjunction with the fixed blade.

When the sewing material is to be cut, the presser foot member is first moved to the evacuation position. Thus, the cutter device descends, in response to which the cutting blade pivots away from the fixed blade. Then, the sewing material (fabric) is moved and the cutter device is caused to rotate about the axis of the needle bar so that the sewing material is positioned between the cutting blade and the fixed blade. After that, the presser foot member is lowered to the predetermined sewing operating position, upon which the cutting blade is caused to pivot toward the fixed blade, in response to the ascending movement of the cutter device, so that the sewing material is cut near its sewing end point.

With the cutter device disclosed in patent literature 1, the sewing material is cut near its sewing end point, i.e. at the needle drop position, and thus, the human operator has to pull out a certain length of the sewing material from the guide member before resuming or restarting the sewing operation after the cutting of the sewing material. Such operation tends to be extremely cumbersome (requiring time and labor) particularly in a case where the sewing machine is a multi-head sewing machine.

Japanese Patent Application Laid-open Publication No. 2007-68829 (hereinafter referred to as "patent literature 2") discloses a sewing machine where a sewing-material cutter device is provided in a position remote from the needle drop position in order to avoid the aforementioned inconvenience. The cutter device disclosed in patent literature 2 is constructed to be movable between an evacuation position where the cutter device does not impede the sewing operation and a cutting position where it can cut the sewing material, and it includes a catching or hook portion for catching the sewing material as the cutter device moves from the evacuation position to the cutting position, a fixed blade, and a cutting blade movable in interlocked relation to further movement of the cutter device after the sewing material is caught by the catching portion.

When the sewing material is to be cut, the sewing workpiece (fabric) is moved so that the sewing end point of the swing material is moved close to the cutter device. Then, the cutter device is moved from the evacuation position to the cutting position so that the sewing material is caught by the catching portion. Then, the cutter device is moved to a further cutting position, in response to which the cutting blade cuts the sewing material near the sewing end point through cooperation between the cutting blade and the fixed blade. Because the sewing material (fabric) is moved as above when it is to be cut, it is pulled out from the guide member by a length corresponding to a moved amount of the sewing material. Thus, the human operator does not pull out the sewing material from the guide member when resuming the sewing operation, which can reduce the burden on the human operator.

However, with the conventional techniques represented by patent literature 1 and patent literature 2, there is a need for a human operator to cut off, after completion of the sewing, the portion (i.e., portion preceding a sewing start point) of the sewing material having been pulled out in advance from the guide prior to the sewing. Namely, with the conventional techniques, time and labor are required for, after completion of the sewing, cutting the portion (i.e., portion preceding the sewing start point) of the sewing material having been pulled out in advance from the guide prior to the sewing. Also, such a portion or length of the sewing material having been pulled out in advance, i.e. a length necessary for reliably sewing a sewing start portion, would undesirably become a waste of the sewing material.

SUMMARY OF THE INVENTION

In view of the foregoing, it is an object of the present invention to provide an improved sewing machine which does not require time and labor for cutting off a portion of a sewing material preceding a sewing start point and can avoid wasting of the portion of the sewing material preceding the sewing start point.

In order to accomplish the above-mentioned object, the present invention provides an improved sewing machine which includes: a vertically-driven needle bar; a sewing needle mounted to a lower end portion of the needle bar; a rotary member provided coaxially with the needle bar and freely rotatable about an axis of the needle bar; and a guide mounted to the rotary member for guiding a sewing material to a needle drop position of the sewing needle, and which is constructed to sew the sewing material, guided by the guide, onto a sewing workpiece by lock stitching while controlling rotation of the rotary member, in accordance with a moving direction of the sewing workpiece based on embroidery data, to thereby change an orientation of the guide in such a manner as to optimize a direction in which the sewing material is to be guided to the needle drop position. The sewing machine of the present invention comprises a retention mechanism for retaining an end portion of the sewing material, having been guided by the guide, at a position opposed to the guide with the sewing needle interposed therebetween, and sewing of the sewing material onto the sewing workpiece is started with the end portion of the sewing material retained by the retention mechanism, and then, retention, by the retention mechanism, of the end portion of the sewing material is canceled.

According to the present invention, an end portion of the sewing material is retained by the retention mechanism at a position opposed to the guide with the sewing needle interposed therebetween, prior to start of sewing of the sewing material. Thus, the sewing material can be reliably sewn onto the sewing workpiece. As a consequence, operation for pulling out the sewing material from the guide prior to the start of the sewing is unnecessary. Further, because an unsewn portion of the sewing material preceding the sewing start point is equal to a length from the sewing start point to the retention mechanism, there is no need to pull out the sewing material in advance, and thus, the unsewn portion can be only a nominal amount. Thus, there is no need to cut off the unsewn portion of the sewing material preceding the sewing start point, which can advantageously avoid wasting the sewing material.

The present invention also provides an improved sewing machine which includes: a vertically-driven needle bar; a sewing needle mounted to a lower end portion of the needle bar; a rotary member provided coaxially with the needle bar and freely rotatable about an axis of the needle bar; and a guide mounted to the rotary member for guiding a sewing material to a needle drop position of the sewing needle, and which is constructed to sew the sewing material, guided by the guide, onto a sewing workpiece by lock stitching while controlling rotation of the rotary member, in accordance with a moving direction of the sewing workpiece based on embroidery data, to thereby change an orientation of the guide in such a manner as to optimize a direction in which the sewing material is to be guided to the needle drop position, the sewing machine comprising: a cutter device mounted to a side of the rotary member opposed to the guide in such a manner that the cutter device is rotatable together with the rotary member, the cutter device cutting the sewing material, having been paid out from the guide, at a predetermined cutting position; and a retention mechanism incorporated in the cutter device for retaining an end portion of the sewing material at a position closer to the guide than the predetermined cutting position and in interlocked relation to cutting, by the cutter device, of the sewing material.

According to the present invention, which includes the cutter device and the retention mechanism incorporated in the cutter device for retaining the end portion of the sewing material at a position closer to the guide than the predetermined cutting position, an operation for cutting the sewing material at the cutting position can be performed automatically by the cutter device upon completion of sewing. Further, because the end portion of the sewing material (i.e., portion preceding a sewing start point at which the sewing is to be resumed or restarted) is retained by the retention mechanism, operation for pulling out the sewing material from the guide prior to the restart of the sewing is unnecessary. Further, thus, there is no need to cut off an unsewn portion of the sewing material preceding the sewing start point, which can advantageously avoid wasting the sewing material. Further, with the aforementioned construction, a human operator has to perform neither the operation for cutting, after completion of sewing, the sewing material at the cutting position nor an unsewn portion of the sewing material preceding the sewing start point. Thus, it is possible to reduce a burden on the human operator. In this way, the present invention can achieve a significantly enhanced operating efficiency, particularly in a multi-head sewing machine.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF DRAWINGS

For better understanding of the object and other features of the present invention, its preferred embodiments will be described hereinbelow in greater detail with reference to the accompanying drawings, in which.

DETAILED DESCRIPTION

Figure 1:
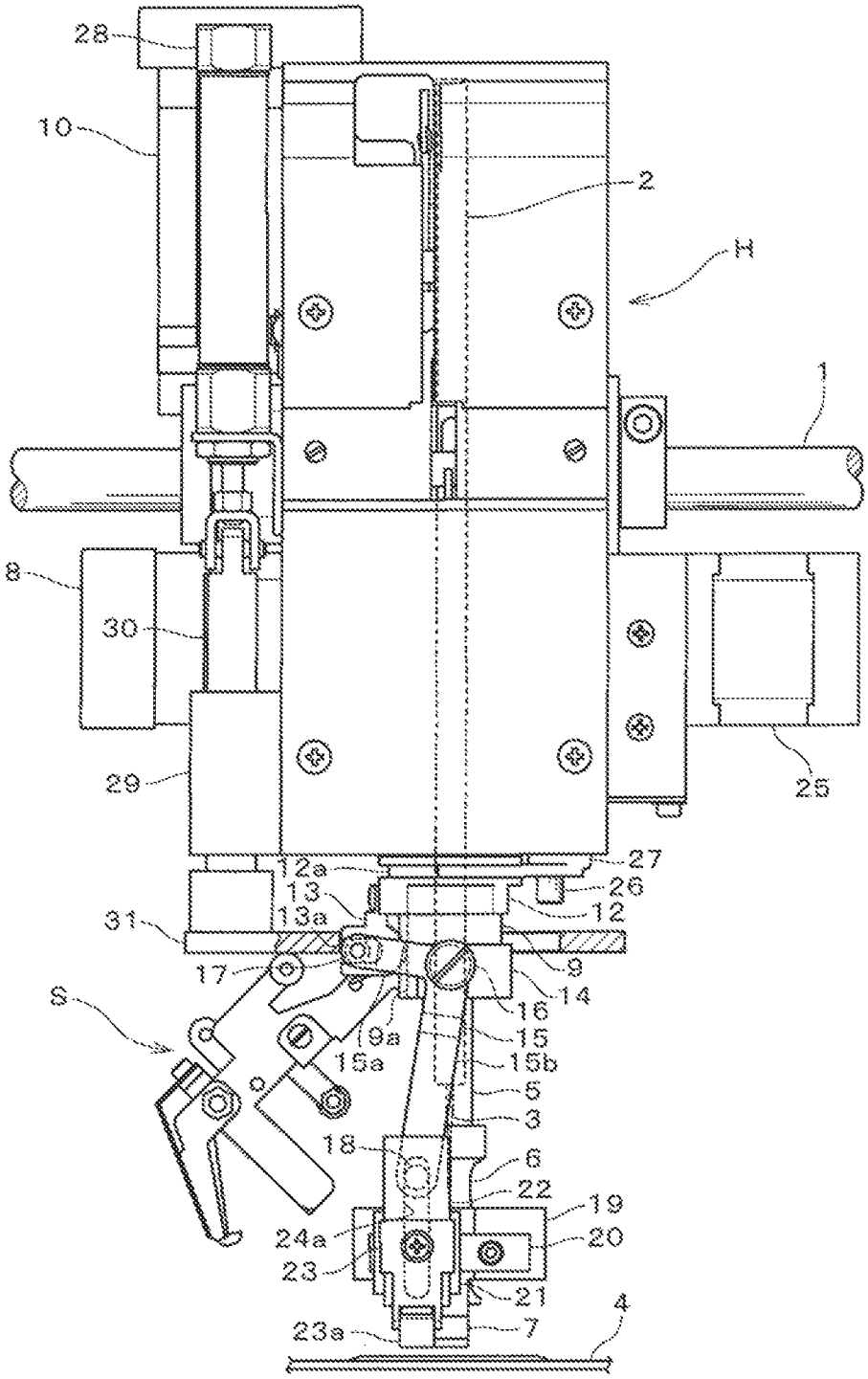
FIG. 1 is a front view of a machine head of a first embodiment of a sewing machine of the present invention.
Figure 2:
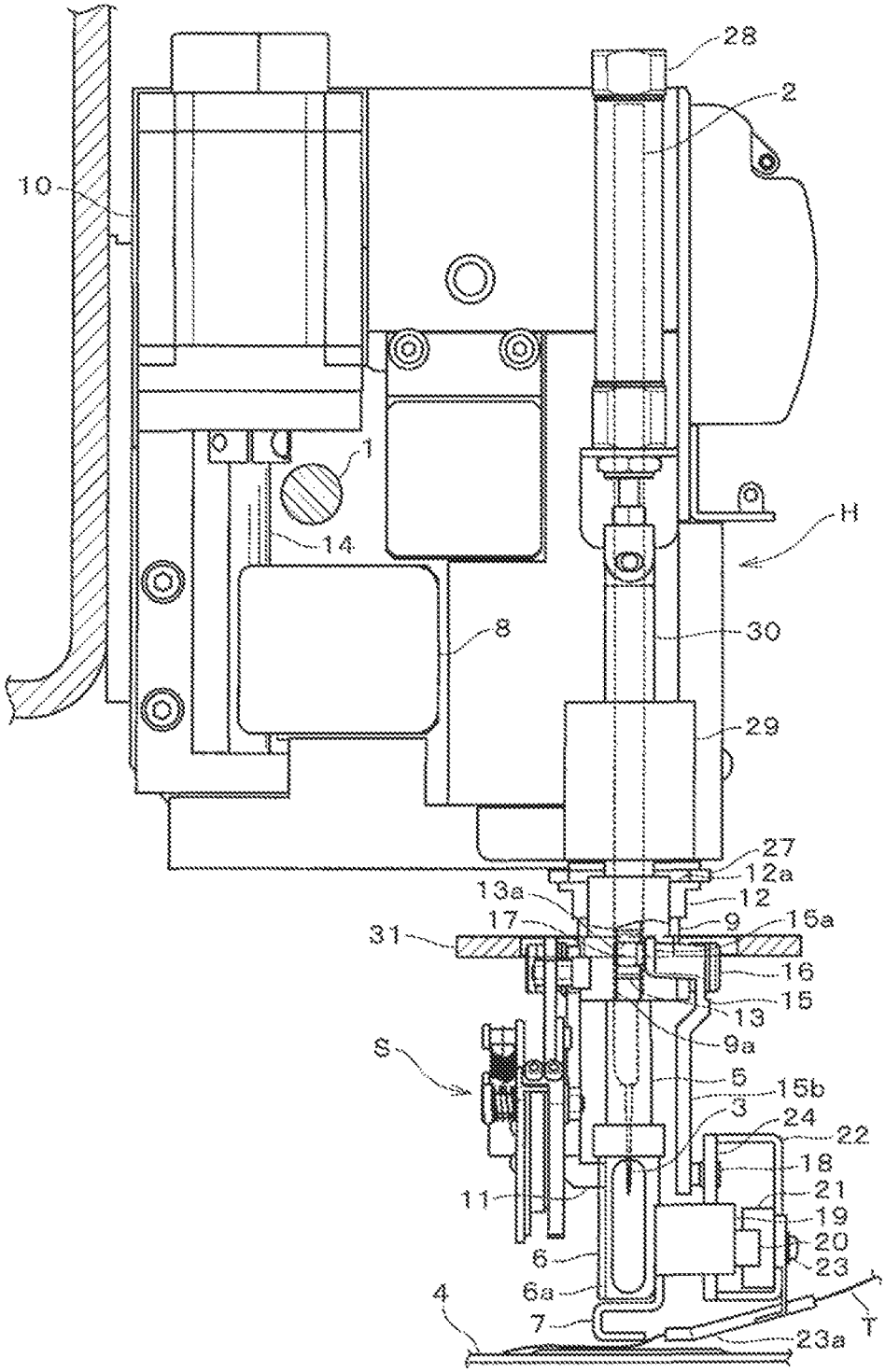
FIG. 2 is a left side view of the machine head shown in FIG. 1.

FIG. 1 is explanatory of a general construction of a first embodiment of a sewing machine to which are applied basic principles of the present invention; more specifically, FIG. 1 is a front view of a machine head H of the sewing machine. Whereas the embodiment can be constructed as a multi-head sewing machine having a plurality of machine heads H, only one machine head H is shown to facilitate understanding of the illustration and following description. FIG. 2 is a left side view of the machine head H shown in FIG. 1. The machine head H operates to sew an elongated sewing material (such as a tape or cord), wound on a not-shown bobbin, onto a sewing workpiece (such as a fabric). Main machine shaft 1 extends through the machine head H. A needle bar 2 is reciprocatively driven vertically or in an up-down direction, together with a sewing needle 3 fixed to the lower end thereof, by means of a not-shown needle bar drive mechanism. Lock stitching is performed in the well-known manner through the up-and-down movement of the sewing needle 3 and rotation of a not-shown rotary hook disposed beneath a needle plate 4.

Support cylinder 5 is provided around the outer periphery of the needle bar 2 in such a manner that it is rotatable about its axis and vertically movable relative to the needle bar 2 while being guided along the inner peripheral surface of a not-shown sleeve fixed to a lower end portion of the machine head H. A presser foot support 6 is fixed to a lower end portion of the support cylinder 5. The presser foot support 6 is formed into a generally bifurcated shape, having two leg sections, by a vertically elongated hole being formed therethrough. A vertically-elongated key groove 6*a* is formed in the outer surface of one of the leg sections of the presser foot support 6, while a presser foot 7 is fixed to a lower portion of the other leg portion. As the support cylinder 5 is moved vertically in an up-down direction by being driven via an elevator motor 8, the presser foot support 6 and the presser foot 7 fixed to the support cylinder 5 moves in the up-down direction.

Rotary cylinder (i.e., rotary member) 9 is provided on the outer periphery of the not-shown fixed sleeve. The rotary member 9 is mounted concentrically with the needle bar 2 and freely rotatable about the axis of the needle bar 2, and it is also rotatable about its axis by being driven via an orientation control motor 10. A key member 11 is provided on a lower end portion of the rotary member 9 and has an end portion engaged in the key groove 6*a* of the presser foot support 6. The presser foot support 6 and the presser foot 7 are connected to the rotary member 9 via the key member 11 in such a manner that it can rotate about the axis of the needle bar 2 in response to rotation of the rotary member 9. Namely, the presser foot 7 vertically moves in response to vertical movement of the support cylinder 5 and rotates in response rotation of the rotary member 9.

An interlocking member 12 is provided along the outer periphery of the rotary cylinder (member) 9 in such a manner that it is vertically movable and rotatable. A connecting piece 13 is connected to the interlocking member 12. With the connecting piece 13 engaged in an engaging groove 9*a* formed in the outer periphery of the rotary member 9, the interlocking member 12 rotates together with the rotary member 9.

An annular groove 12*a* is formed in the outer periphery of the interlocking member 12, and a distal end portion (forked portion) of a drive arm 27 is engaged in the annular groove 12*a*. The drive arm 27 is vertically movably supported on a guide shaft 26 extending in the vertical direction of FIG. 1 or in the axial direction of the needle bar 2. As the drive arm 27 moves vertically along the guide shaft 26 by being driven via a drive motor 25, the interlocking member 12 and the connecting piece 13 move vertically.

A swing lever 15 is fixed to the rotary cylinder 9 via a first bracket 14 in such a manner that it is pivotable or swingable, about a first lever pin 16 mounted to the first bracket 14, leftward and rightward from the axis of the needle bar 2 relative to the rotary member 9. The swing lever 15 includes an upper arm section 15*a* extending laterally from the position of the first lever pin 16 and a lower arm section 15*b* extending downward from the position of the first lever pin 16. A roller 17 is mounted on a distal end portion of the laterally-extending upper arm section 15*a* and engaged in a connecting groove 13*a* of the connecting piece 13. Further, a roller 18 is mounted on a lower end portion of the lower arm section 15*b* and fitted in a fitting hole 24*a* of a later-described actuating plate 24.

A generally C-shaped (as viewed in plan) support member 19 is formed integrally with the presser foot 7, and a guide rail 20 is fixed to an opening side (right side in FIG. 2) of the support member 19. A slider 21 is provided on the guide rail 20 for horizontal movement therealong in a left-right direction. A guide member 23 is fixed to the slider 21 via a second bracket 22. Namely, the guide member 23 is connected to the presser foot 7 via the second bracket 22, slider 21 and guide rail 20. A guide 23*a* for passing therethrough the sewing material T and supplying the sewing material T to the needle drop position of the sewing needle 3 is provided at the lower end of the guide member 23. As apparent from FIG. 2, the guide 23*a* is provided in such a manner that its distal end portion (sewing-material feeding outlet) is located close to the lower end of the presser foot 7, i.e. close to the needle drop position.

Further, an actuating plate 24 is fixed to the second bracket 22. The actuating plate 24 has a fitting hole 24*a* elongated in the axial direction of the needle bar 2 (i.e., in the up-down direction in FIG. 1), and the roller 18 of the lower arm section 15*b* of the swing lever 15 is fitted in the elongated fitting hole 24*a*. In this manner, the second bracket 22 and the guide member 23 are connected to the swing lever 15.

The interlocking member 12 and the connecting piece 13 are vertically moved in response to vertical (up-down) movement of the drive arm 27, and, in response to the vertical movement of the connecting piece 13, the swing lever 15 swings about the first lever pin 16 leftward and rightward relative to the rotary member 9 (axis of the needle bar 2). Namely, the vertical movement of the drive arm 27, interlocking member 12 and connecting piece 13 through driving by the drive motor 25 is converted into swinging movement of the swing lever 15. In response to the swinging movement of the swing lever 15, the second bracket 22 and the guide member 23 connected to the swing lever 15 reciprocatively slide along the guide rail 20 in the left-right direction relative to a direction in which the sewing progresses (i.e., sewing progressing direction). Through such reciprocative sliding movement of the guide member 23, the sewing material T passed through the guide 23*a* is supplied to the needle drop position while being zigzagged leftward and rightward in a predetermined pattern relative to the sewing progressing direction. In this manner, the sewing material T is sewn onto the sewing workpiece (fabric) in a staggering or zigzagging fashion.

Because the guide member 23 is connected to the presser foot 7 and swing lever 15, it rotates about the axis of the needle bar 2 in response to rotation of the rotary member 9 caused through driving of the orientation control motor 10. A direction in which the sewing material T is guided by the guide 23*a* (i.e., sewing material guiding direction) is changed in accordance with a rotating position of the guide member 23. Such arrangements can control the rotation of the rotary member 9 in accordance with a moving direction of the fabric based on embroidery data and thereby change the orientation of the guide member 23 (guide 23*a*) so that a direction of guiding of the sewing material T to the needle position can be optimized, in the manner well known in the art.

The following describe a cutter device S that cuts the sewing material T. In FIGS. 1 to 9, there is shown the cutter device S employed in the first embodiment. An air cylinder 28 for driving the cutter device S is fixed to the left side surface of the machine head H. The air cylinder 28 is connected to a rod 30 vertically-movably supported on a guide 29 that is in turn fixed to the machine head H. A slip plate 31 of a doughnut shape is connected to the lower end of the rod 30, and the rotary cylinder 9 is disposed in a central hole of the slip plate 31.

Figure 3:
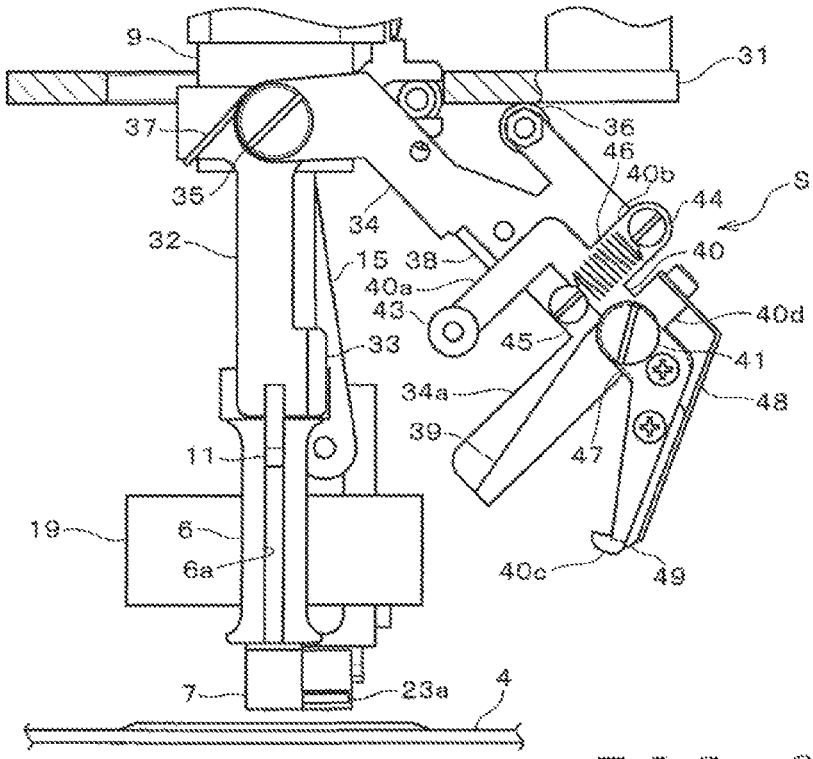
FIG. 3 is a front view of a cutter device employed in the first embodiment, which shows the cutter device from a back side of the machine head shown in FIG. 1.
Figure 4:
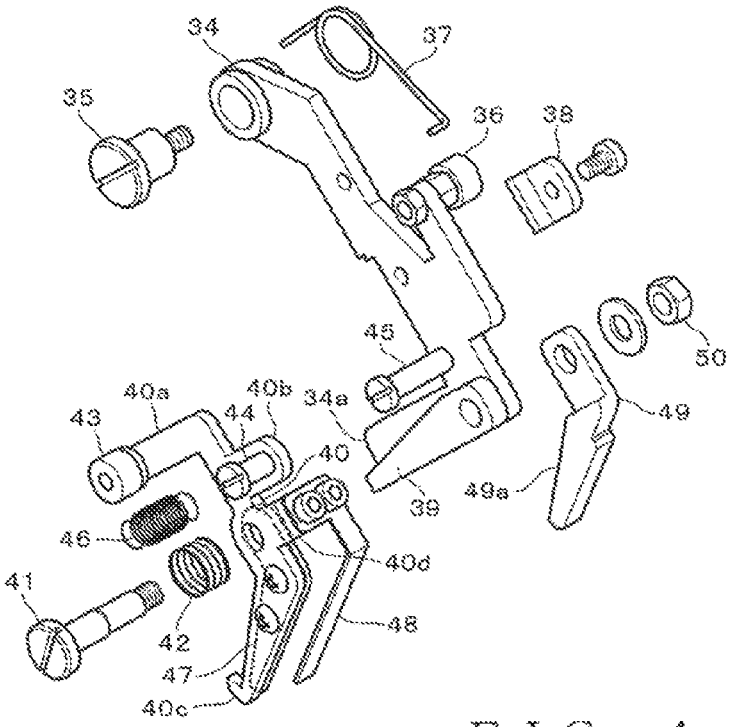
FIG. 4 is an exploded perspective view of the cutter device of FIG. 3.

FIG. 3 is a front view of the cutter device S, which shows the cutter device S from the back side of the machine head shown in FIG. 1. Further, FIG. 4 is an exploded perspective view of the cutter device S of FIG. 3.

A base member 34 of the cutter device S is mounted, via a second lever pin 35, to a third bracket 32 fixed to the rotary cylinder 9 in such a manner that it is pivotable about the second lever pin 35. The third bracket 32 has the above-mentioned key member 11 and stopper 33 integrally formed therewith.

As apparent from FIGS. 3 and 1, a position at which the base member 34 is locked by the second lever pin 35 (i.e., surface where the second lever pin 35 is fixed) is opposed to a position where the swing lever 15 is fixed by the first lever pin 16 (i.e., surface where the first lever pin 16 is fixed), with the rotary cylinder 9 interposed between. Further, because the base member 34 is mounted to the third bracket 32 fixed to the rotary cylinder 9, the cutter device S is rotatable about the needle bar 2 together with the rotary cylinder 9.

A roller 36 capable of abutting against a ring-shaped portion of the slip plate 31 is provided on the base member 34. The base member 34 is normally biased upwardly (counterclockwise in FIG. 3), by a torsion spring 37, so that the roller 36 is normally kept in abutting engagement with the lower surface of the slip plate 31 as shown in FIG. 3. Thus, when the slip plate 31 has been lowered or moved downward by the air cylinder 28, downward force is applied to the base member 34 via the roller 36 kept in abutting engagement with the lower surface of the slip plate 31, so that the base member 34 pivots downward about the second lever pin 35. Further, because the base member 34 is normally biased upwardly by the torsion spring 37, the base member 34 pivots upward about the second lever pin 35 as the slip plate 31 is lifted or moved upward by the air cylinder 28. Namely, by vertical movement control, by the air cylinder 28, of the slip plate 31, the cutter device S is movable between the evacuation position and a cutting operation position. The evacuation position is a position where the cutter device S is held evacuated upwardly from the later-described cutting operation position without the operation for sewing the sewing material T shown in FIG. 3 being not adversely influenced. Further, the cutting operation position is a position where the cutter device S has been moved downward from the evacuation position for cutting the sewing material T (see, for example, FIG. 8).

The base member 34 (cutter device S), which is normally held in the evacuation position, is moved to the cutting operation position when the sewing material T is to be cut. An elastic member 38 is provided on the base member 34 and abuts against the stopper 33 in the cutting operation position. Namely, the cutting operation position of the base member 34 (cutter device S) is regulated by the elastic member 38.

Although the base member 34 is constructed to rotate about the axis of the needle bar 2 together with the rotary cylinder 9, the base member 34 is kept in abutting engagement with the lower surface of the slip plate 31, irrespective of a rotating position of the ring-shaped portion of the slip plate 31, because the roller 36 is always kept in abutting engagement with the slip plate 31 (namely, the roller 36 is kept in a state capable of transmitting up-down movement of the slip plate 31 to the base member 34).

The base member 34 has a knife fixing section 34*a* formed on its lower end portion and extending laterally from the lower end portion, and a knife 39 is fixed to the knife fixing section 34*a*. A knife base 40 provided with a cutting knife 47 is mounted to the knife fixing section 34*a* of the base member 34. A later-described hook section 40*c* is formed on a lower portion of the knife base 40. In the knife fixing section 34*a*, the knife base 40 is supported by a support pin 41 in such a manner that it is pivotable about and movable along the axis of the support pin 41. The knife base 40 is normally biased, by a first coil spring 42 provided on the support pin 41, toward the knife fixing section 34*a*, so that the knife base 40 is always held in abutting engagement with the fixed knife 39 fixed to the knife fixing section 34*a*.

The knife base 40 includes, on its upper portion, a first arm section 40*a* extending leftward in FIG. 3, and a second arm section 40*b* extending rightward in FIG. 3.

A first pin 44 is provided on a distal end portion of the second arm section 40*b*, and a second coil spring 46 is connected between the first pin 44 and a second pin 45 fixed to the base member 34. By the biasing force of the second coil spring 46, the knife base 40 is normally held in a pivoting position (position shown in FIG. 3) where the respective proximal ends of the first and second arm sections 40*a* and 40*b* abut against the second pin 45.

Further, a roller 43 is provided on a distal end portion of the first arm section 40*a* and abuts against the stopper 33 as the base member 34 pivots from the evacuation position toward the cutting operation position. As the base member 34, pivoting (clockwise in FIG. 3) from the evacuation position toward the cutting operation position, further pivots with the roller 43 on the distal end portion of the first arm section 40*a* abutting against the stopper 33, counterclockwise (FIG. 3) force is applied to the roller 43 abutting against the stopper 33, and thus, the knife 40 pivots clockwise about the support pin 41.

A hook section 40*a* extending obliquely leftward and downward in FIG. 3 is provided on a lower end portion of the knife base 40. The sewing material T can be engaged by, or hooked on, the hook section 40*a*. A cutting knife 47 is fixed to the hook section 40*c*. Because the knife base 40 is held in the pivoting position of FIG. 3 by the biasing force of the second coil spring 46, the hook section 40*c* (cutting knife 47) is normally held in a position spaced form the fixed knife 39.

As the base member 34 moves from the evacuation position further toward the cutting operation position (i.e., pivots clockwise in FIG. 3) with the roller 43 on the distal end portion of the first arm section 40*a* abutting against the stopper 33, the cutting knife 47 on the lower portion of the of the knife base S moves to a position where it crosses the fixed knife 39. The cutter device S is constructed to cut the sewing material T, engaged by the hook section 40*c*, at a predetermined cutting position as the cutting knife 47 and the fixed knife 39 cross each other.

A third arm section 40*d* extending in the axial direction of the support pin 41 is formed on the right side of a substantially middle region of the knife base 40. A leaf spring 48 extending in generally parallel to the hook section 40*c* (obliquely leftwardly and downwardly in FIG. 3) is fixed to a distal end portion of the third arm section 40*d*. The leaf spring 48 is disposed to project from a surface opposite from the surface of the base member 34 having the knife base 40 mounted (see FIG. 4 and FIG. 6) thereon.

The support pin 41 extends through the knife base 40 and base member 34, and a retention member 49 is swingably mounted on a distal end portion of the support pin 41 projecting out from a surface opposite from the above-mentioned mounting surface. A retaining portion 49*a* extending in generally parallel to the hook section 40*c* (obliquely leftwardly and donwardly in FIG. 3) is formed on a distal end portion of the retention member 49. The upper surface of the retaining portion 49*a* contacts the bottom surface of the knife fixing section 34*a* as the knife base 40 pivots in the clockwise direction of FIG. 3.

The retention member 49 is regulated in position by a nut 50 fixed to a distal end portion of the support pin 41, and, with the retention member 49 mounted to the base member 34, the lower surface of the retaining portion 49*a* of the retention member 49 is supported by the leaf spring 48 fixed to the third arm section 40*d* of the knife base 40. Thus, as the knife base 40 pivots clockwise in FIG. 3, the retention member 49 pivots in the same direction and the upper surface of the retaining portion 49*a* contacts the bottom surface of the knife fixing section 34*a*, so that the sewing material T can be sandwiched between the upper surface of the retaining portion 49*a* (retention member 49) and the bottom surface of the knife fixing section 34*a*. Namely, with the construction where the retaining portion 49*a* (retention member 49) and the knife fixing section 34*a* cooperate (i.e., function as a pair of sandwiching members) to sandwich the sewing material T, there can be constructed a holding mechanism for holding an end portion of the sewing material T.

Because the holding mechanism (retaining portion 49*a* and knife fixing section 34*a*) is provided in a lower portion of the base member 34 (cutter device S) in opposed relation to the swing lever 15 and guide member 23 of the rotary cylinder 9, the sewing material T is retained at a position opposed to the guide 23*a* with the needle bar 2, coaxially provided with the rotary cylinder 9, disposed therebetween.

Because the holding mechanism (retaining portion 49*a* and knife fixing section 34*a*) is assembled to the rotary cylinder 9 via the base member 34 (cutter device S), the holding mechanism (retaining portion 49*a* and knife fixing section 34*a*) is rotatable about the axis of the needle bar 2 together with the rotary cylinder 9.

The following describe behavior of the first embodiment when sewing the sewing material T onto a sewing workpiece, such as a fabric. When sewing the sewing material T, the foot presser 7 and the guide member 23 are in a sewing position as shown in FIG. 3. During sewing of the sewing material T, the base member 34 (cutter device S) is held in the evacuation position of FIG. 3. The sewing material (elongated sewing material, such as a tape or cord) T, wound on a not-shown bobbin positioned above the machine head H, is paid out from the bobbin and directed to the needle drop position of the sewing needle 3 via the guide 23*a* of the guide member 23 (see FIG. 2). In this state, the not-shown fabric is subjected to movement control in X and Y directions on the basis of predetermined embroidery data, and the needle bar 2 is driven up and down, so that lock stitching is performed in the well-known manner through cooperation between the sewing needle 3 and a not-shown rotary hook. Note that the "X and Y directions" represent planar directions on the needle plate 4.

At that time, the foot presser 7 is moved up and down by the an elevator motor 8 at predetermined timing relative to the up-down movement of the needle bar 2, to thereby perform the well-known fabric holding function. Further, the drive arm 27 is driven up and down at predetermined timing relative to the up-down movement of the needle bar 2, and the swing lever 15 is swung by up-down movement of the interlocking member 12 responsive to the up-down movement of the interlocking member 12. Thus, the sewing material T, having been guided via the guide 23*a* to the needle drop position of the sewing needle 3, is swung to the left and right of the needle drop position of the sewing needle 3, for example, per reciprocating vertical (up-down) movement of the needle bar 2. As a result, the sewing material T sequentially paid out from the bobbin is sequentially sewn onto the fabric through so-called zigzag stitching.

As apparent from FIG. 1, the actuating plate 24, second bracket 22 and guide member 23 are engaged with the swing lever 15 by the roller 18 being fitted in the vertically-elongated fitting hole 24*a*. In other words, because the actuating plate 24, second bracket 22 and guide member 23 engaged with the swing lever 15 is movable vertically within the vertical length range of the fitting hole 24*a*, an amount of reciprocative sliding movement of the guide member 23 responsive to the swinging movement of the swing lever 15 does not vary even when the guide member 23 varies in vertical position. Thus, although the guide member 23 too vertically moves together with the presser foot 7, the vertical movement of the guide member 23 does not influence sewing of the sewing material T.

By the rotary cylinder 9 being rotated by the orientation control motor 10 during the sewing of the sewing material T by lock stitching, the guide 23*a* is controlled to be positioned ahead in a relative advancing direction of the machine head H responsive to movement in the X and Y directions of the fabric. Thus, the sewing material T is appropriately directed to the needle drop position of the sewing needle 3.

The following describe behavior of the first embodiment when cutting the sewing material T via the cutter device S. Upon completion of the sewing of the sewing material T, the guide member 23 is evacuated, by being driven via elevator motor 8, from the sewing position of FIG. 3 to the evacuation position of FIG. 5 together with the presser foot 7.

A sewing end point of the sewing material T is moved away from the needle drop position by the fabric, having the sewing material T sewn thereto, being moved in the X and Y directions. In this manner, a length of the sewing material T corresponding to an amount of the movement of the fabric is newly pulled out or paid out from the guide 23*a*. FIG. 6 is a right side view of the cutter device S shown in FIG. 5, which particularly shows a state where the fabric has been moved in the X and Y directions; in other words, FIG. 6 is a left side view of the cutter device S when the machine head H is viewed from the front as in FIG. 1.

The movement of the fabric is effected in such a manner that the length or portion of the sewing material T having been newly pulled out or paid out from the guide 23*a* in response to movement of the fabric traverses a region under the presser foot 7 and the cutter device S. By the fabric being moved in the X and Y directions with the guide member 23 held in the upper evacuation position, the sewing material T, having been newly pulled out from the guide 23*a* in response to the movement of the fabric, extends to traverse the region under the cutter device S and slant upward from the sewing end point to the guide 23*a*. In this manner, the sewing material T can be hooked by the hook section 40*c* formed on the distal end portion of the knife base 40 of the cutter device S.

Figure 5:
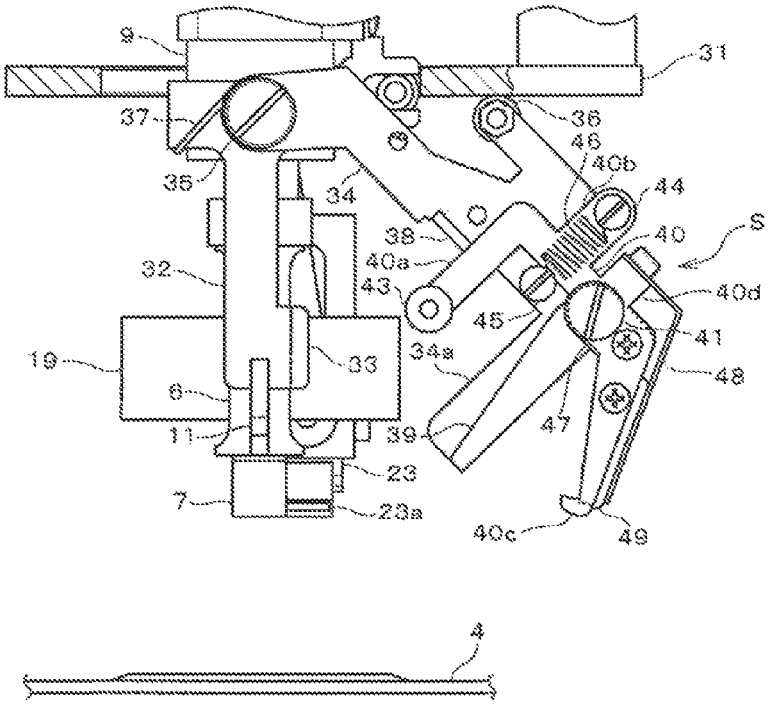
FIG. 5 is a front view of the cutter device of FIG. 3, which particularly shows a presser foot and guide member evacuated to an evacuation position.
Figure 6:
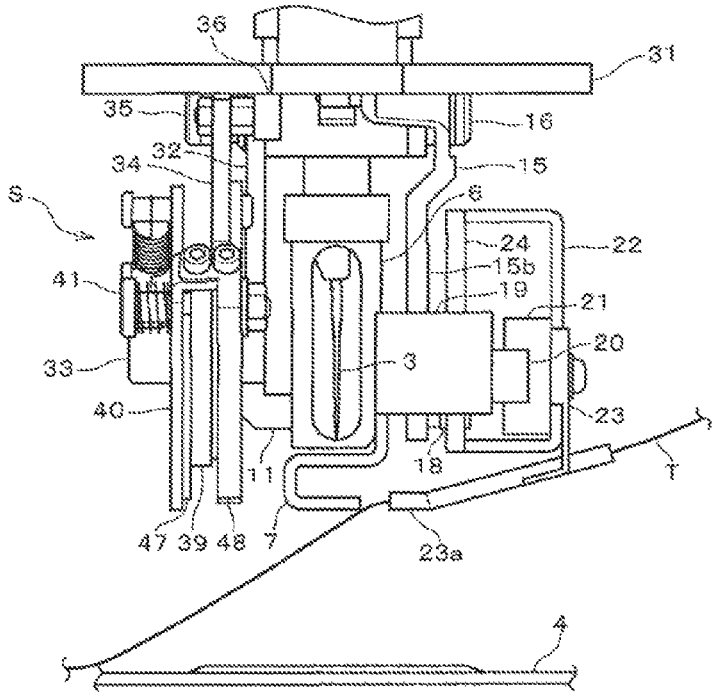
FIG. 6 is a right side view of the cutter device of FIG. 5.
Figure 8:
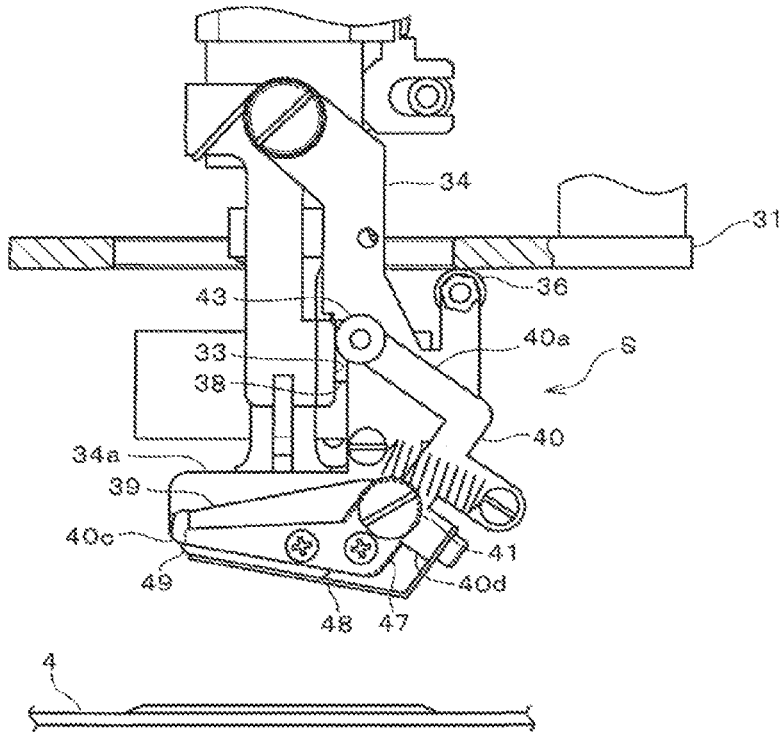
FIG. 8 is a front view of the cutter device of FIG. 3, which particularly shows a moving knife having crossed a fixed knife.

As the air cylinder 28 is activated to lower the slip plate 31 in the state of FIG. 6, the base member 34 (cutter device S) pivots about the second lever pin 35 in the clockwise direction of FIG. 5 and thereby moves from the evacuation position of FIG. 5 to the cutting position of FIG. 8.

The following describe in detail behavior of the knife base 40 during the aforementioned movement. While the base member 34 is in the evacuation position, the knife base 40 is held in the pivoting position of FIG. 5 by the biasing force of the second coil spring 46. Once the knife base 40 moves to the pivoting position of FIG. 7, the roller 43 provided on the first arm section 40*a* of the knife base 40 abuts against the stopper 33 formed on the third bracket 32. By that time, the sewing material T has been lifted traversing the region under the cutter device S as shown in FIG. 6. Thus, in a state where the base member 34 (cutter device S) has been moved to the pivoting position shown in FIG. 7, the distal end of the hook section 40*c* provided on a lower end portion of the knife base 40 has descended to a position lower than the lifted sewing material T.

Figure 7:
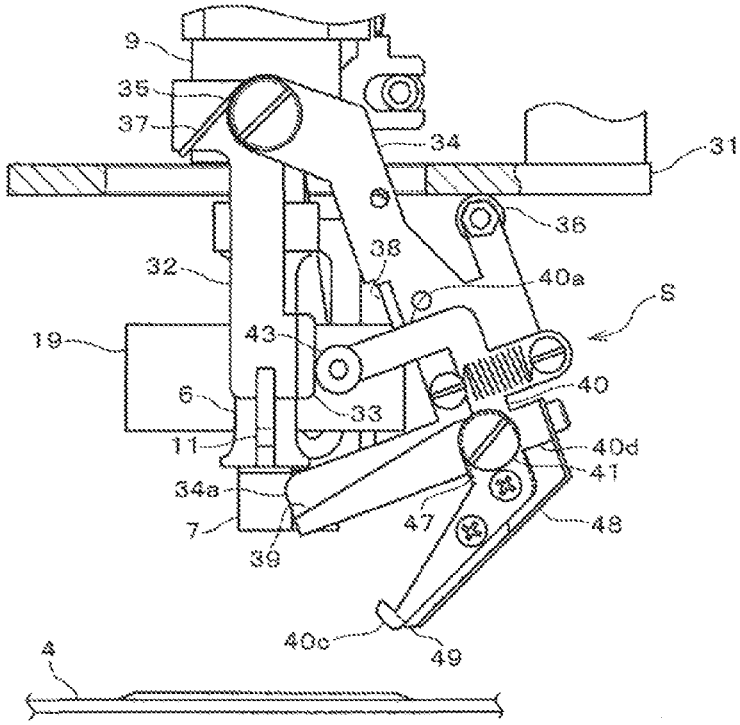
FIG. 7 is a front view of the cutter device of FIG. 3, which particularly shows a base member moved to a cutting position.

As the base member 34 further pivots with the roller 43 kept abutting against the stopper 33, the knife base 40 pivots in the clockwise direction of FIG. 7 about the support pin 41. Because the lower end portion of the knife base 40 has descended to a position lower than the lifted sewing material T as noted above, the sewing material T can be hooked on the upper surface of the hook section 40*c*. Once the base member 34 (cutter device S) moves to a pivoting position shown in FIG. 8, the knife base 40 rotates until the cutting knife 47 crosses the fixed knife 39 (see FIG. 8). By the cutting knife 47 and the fixed knife 39 crossing each other with the sewing material T hooked on the upper surface of the hook section 40*c*, the sewing material T is cut by the cutter device S. Note that an upper thread extending from the fabric to the sewing needle 3 too is cut simultaneously with the cutting of the sewing material T.

When the sewing material T is to be cut by the cutting knife 47 and fixed knife 39, the retention member 49 rotates in response to the rotation of the knife base 40 so that the upper surface of the retaining portion 49*a* contacts the bottom surface of the knife fixing section 34*a*, and thus, the sewing material T hooked on the upper surface of the hook section 40*c* can be sandwiched between the upper surface of the retaining portion 49*a* and the bottom surface of the knife fixing section 34*a*.

In the cutter device S, as shown in FIG. 6, the retention member 49 (leaf spring 48) is provided closer to the guide 23*a* than the cutting position of the sewing material T (i.e., position where the cutting knife 47 and the fixed knife 39 cross each other), and thus, a retention mechanism (i.e., construction for sandwiching the sewing material T by means of the retaining portion 49*a* and knife fixing section 34*a*) can retain the sewing material T at a position closer to the guide 23*a* than the cutting position at the time of cutting. Thus, when the sewing material T has been cut, the retention mechanism can retain an end portion of the sewing material T having been pulled out from the guide 23*a*, i.e. an end portion preceding a sewing start point where sewing of the sewing material T is to be resumed or restarted.

When the sewing of the sewing material T is to be restarted, new sewing is started with the base member 34 (cutter device S) held in the cutting position, i.e. with the end portion retained by the retention mechanism (i.e., construction for sandwiching the sewing material T by means of the retaining portion 49*a* and knife fixing section 34*a*). In this state, the sewing material T is traversing the vertical (up-down) movement path of the sewing needle 3. Once the new sewing of the sewing material T is started, the cutting knife 47 and the guide member 23 lower or descend to the sewing position and the rotary cylinder 9 rotates by being driven by the orientation control motor 10, so that the guide 23*a* is positioned ahead in a relative advancing direction of the machine head H based on the movement of the fabric. Then, the needle bar 2 is moved up and down to sew the sewing material T onto the fabric.

Figure 9:
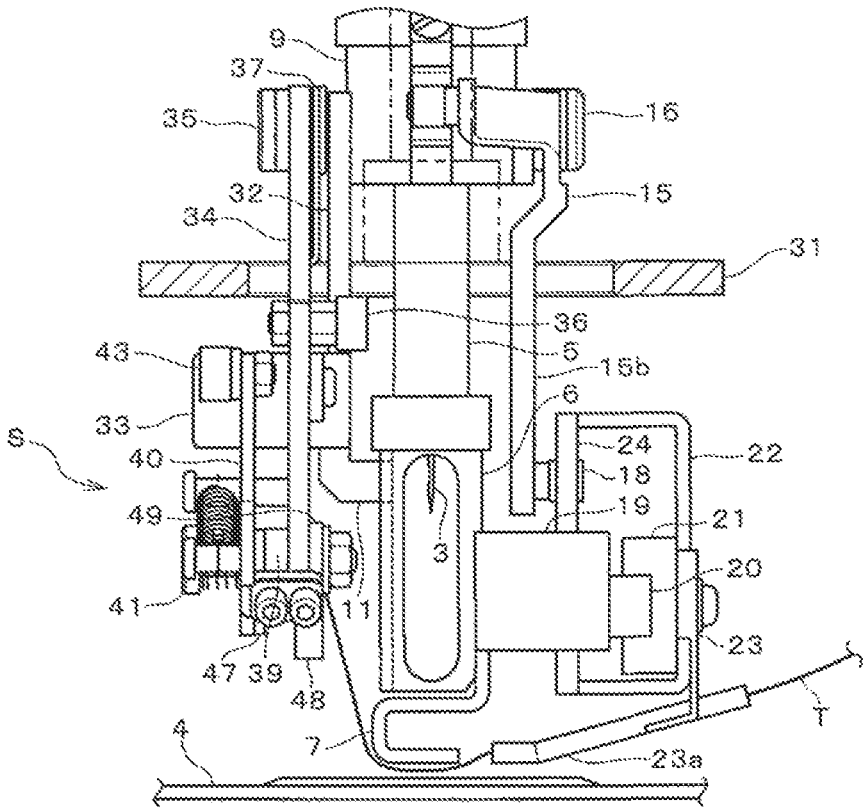
FIG. 9 is a right side view of the cutter device, which particularly shows a manner in which sewing is started with an end portion of a sewing material retained by a retention mechanism.

FIG. 9, which is a right side view of the cutter device S similar to FIG. 6, shows a state where sewing of the sewing material T has been started with the base member 34 (cutter device S) held in the cutting position, i.e. where the presser foot 7 and guide member 23 have descended to the sewing position. In this state, the sewing material T with its end portion retained by the retention mechanism (i.e., construction for sandwiching the sewing material T by means of the retaining portion 49*a* and knife fixing section 34*a*) has been depressed by the presser foot 7. As noted above, the retention mechanism (i.e., construction for sandwiching the sewing material T by means of the retaining portion 49*a* and knife fixing section 34*a*) retains, at a position opposed to the guide 23*a* with the needle bar 2 interposed therebetween, the end portion of the sewing material T having been pulled out from the guide 23*a* (i.e. end portion of the sewing material T preceding the sewing start point where sewing of the sewing material T is to be resumed or restarted), and the retention mechanism (retaining portion 49*a* and knife fixing section 34*a*) is rotatable about the axis of the needle bar 2 together with the rotary cylinder 9. Thus, wherever the guide 23 is located, the sewing material T can be kept retained at a position opposed to the guide 23*a* with the needle bar 2 interposed therebetween, i.e. with the sewing material T traversing the up-down movement path of the sewing needle 3. In this way, the sewing material T can be reliably sewn onto the fabric at the start of the sewing. Further, as apparent from FIG. 9, the length of the end portion of the sewing material T preceding the sewing start point is equal to a length from the needle drop position (sewing start point) to the position where the sewing material T is retained by the retention mechanism (retaining portion 49*a* and knife fixing section 34*a*).

Once the sewing progresses to a certain degree (e.g., three to five stitches) from the sewing start point, the air cylinder 28 is activated to raise the slip plate 31, to thereby return the base member 34 to the upper evacuation position. Thus, the hook section 40*c* gets away from the knife fixing section 34*a*, so that the end portion of the sewing material T is released from the retention by the retaining portion 49*a* and knife fixing section 34*a*. As apparent from the foregoing, a mechanism pertaining to the air cylinder 28 and slip plate 31 function as a drive mechanism for driving the retention mechanism (i.e., construction for sandwiching the sewing material T by means of the retaining portion 49*a* and knife fixing section 34*a*) to perform a sewing-material sandwiching operation and sandwiching canceling operation. Namely, the drive mechanism activates the air cylinder 28 to lower the slip plate 31 to thereby perform the sewing-material sandwiching operation, and activates the air cylinder 28 to raise the slip plate 31 to thereby perform the sandwiching canceling operation.

The following describe a second embodiment of the sewing machine in which a second embodiment of the cutter device S1 is employed, with reference to FIGS. 10 to 13. Elements (devices, members, portions, etc.) similar in function and construction to those shown in FIGS. 1 to 9 are indicated by the same reference numerals as used for the first embodiment and will not be described here to avoid unnecessary duplication.

Figure 10:
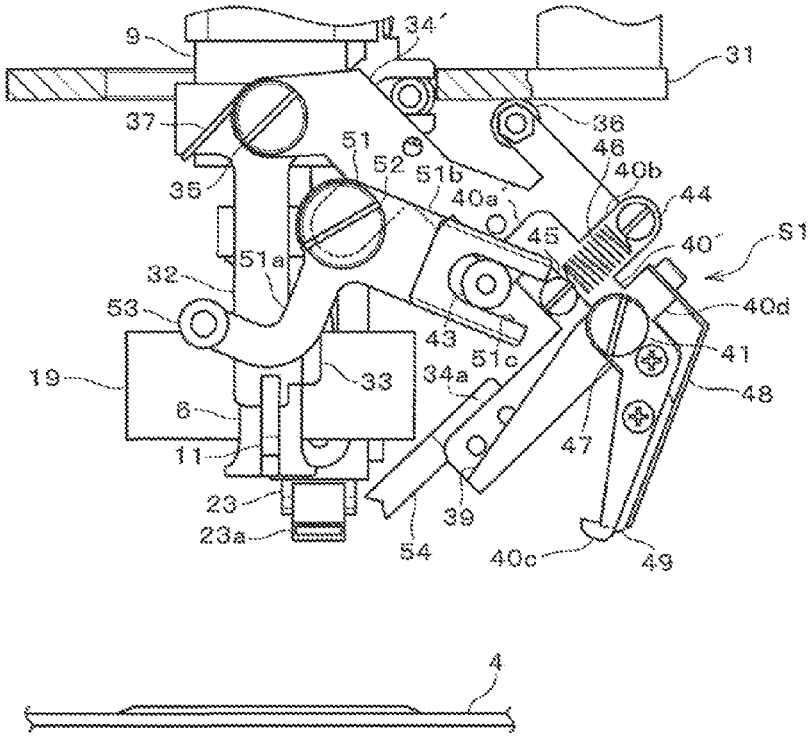
FIG. 10 is a front view of a cutter device in a second embodiment of the present invention, which particularly shows the cutter device in an evacuation position.
Figure 11:
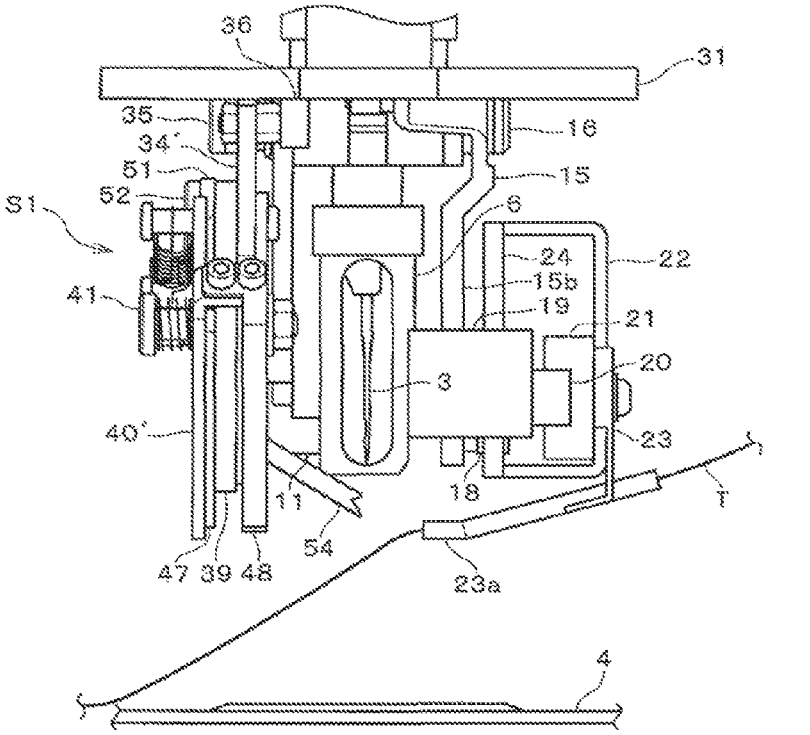
FIG. 11 is a right side view of the cutter device in the second embodiment shown in FIG. 2.

FIG. 10 is a front view of the modified or second embodiment of the cutter device S1 and is similar to FIG. 5 showing the first embodiment. FIG. 11 is a right side view of the second embodiment of the cutter device S1 and is similar to FIG. 6 showing the first embodiment. The cutter device S1 in the second embodiment is different from the cutter device S in the first embodiment in that a knife base 40' provided with the cutting knife 47 is caused to rotate via a link mechanism.

In the second embodiment, a base member 34' is different from the base member 34 in the first embodiment in that it has a support section for supporting a drive lever 51; the drive lever 51 is pivotably supported by the support section by means of a pin 52. The drive lever 51 includes a first arm section 51*a* extending downward in an L shape, and a second arm section 51*b* extending rightward. A roller 53 capable of abutting against the lower surface of the ring-shaped portion of the slip plate 31 is provided on a distal end portion of the first arm section 51*a*. The second arm section 51*b* has a substantial middle portion bent like a crank, and a distal end portion projecting toward a viewer of FIG. 10 and having a U-shaped fitting portion 51*c*. The roller 43 provided on a first arm section 40*a*' of a knife base 40' fits in the U-shaped fitting portion 51*c*. The knife base 40' is different from the knife base 40 in the first embodiment in that the first arm section 40*a*' having the roller 43 provided thereon is smaller in length than the first arm section 40*a*.

A thread hook member 54 is fixed to a distal end portion of the knife fixing section 34*a* having the knife 39 fixed thereto. The thread hook member 54 is bent to be located close to the needle drop position and has a distal end portion formed in a V shape so that the upper thread can be hooked or engaged by the V-shaped distal end portion. Note that the presser foot 7 fixed to a lower portion of the presser foot support 6 in the first embodiment is not provided in the second embodiment.

Next, a description will be given about a manner in which the sewing material is cut by the cutter device S1.

Figure 12:
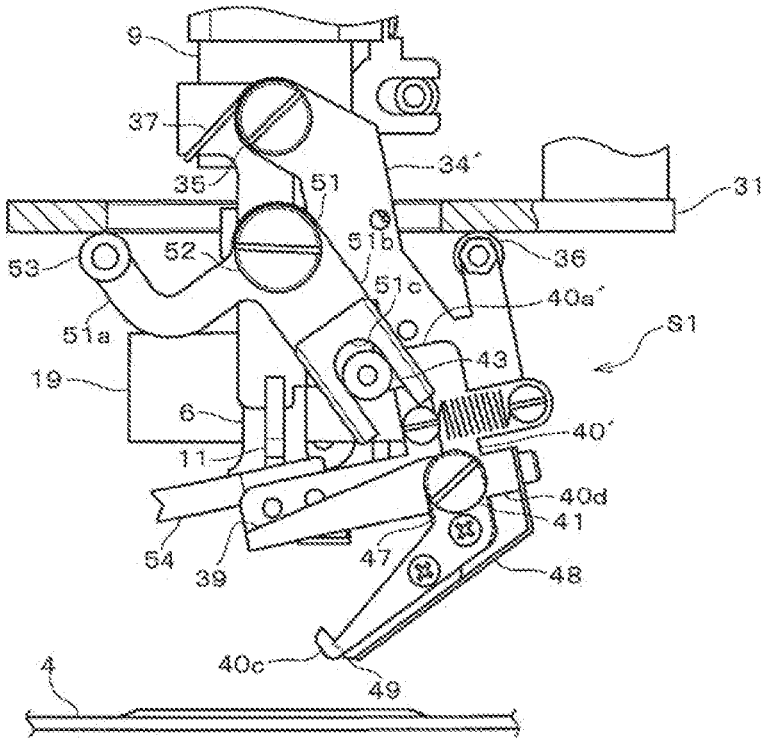
FIG. 12 is a front view of the cutter device in the second embodiment, which particularly shows a base member moved to a cutting position.
Figure 13:
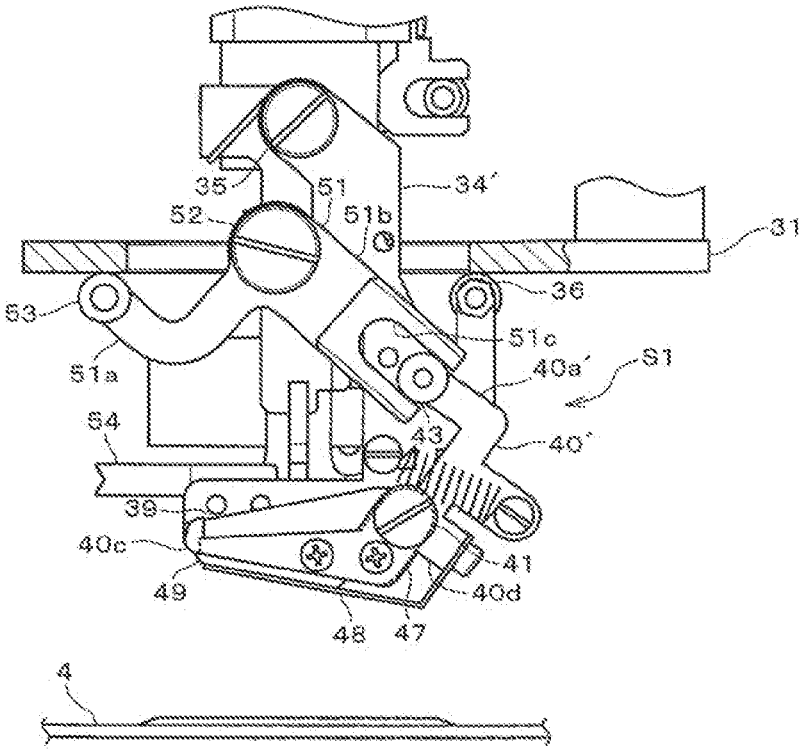
FIG. 13 is a front view of the cutter device in the second embodiment, which particularly shows a moving knife having crossed a fixed knife.

The slip plate 31 is lowered in the state of FIGS. 10 and 11 and the base member 34' is caused to pivot about the second lever pin 35 in the clockwise direction of FIG. 10 so that it moves from the evacuation position of FIG. 10 toward the cutting position of FIG. 13. While the base member 34' is in the evacuation position, as shown in FIG. 10, the knife base 40' is held in the pivoting position of FIG. 10 by the biasing force of the second coil spring 46, and the driver lever 51 having the roller 43 of the knife base 40' fitted in the U-shaped fitting portion 51*c* is also held in the pivoting position of FIG. 10. Once the base member 34' pivots from the position of FIG. 10 to a pivoting position of FIG. 12, the roller 53 provided on the drive lever 51 abuts against the lower surface of the slip plate 31. As the base member 34' pivots to the pivoting position of FIG. 12, the distal end portion of the thread hook member 54 passes the neighborhood of the needle drop position and hooks, on its distal end, the upper thread extending from the sewing needle 3 to thereby evacuate the upper thread from the neighborhood of the needle drop position. Note that, in the second embodiment, a sewing thread cutting operation is effected by a well-known thread cutter device before the sewing material T is cut. Thus, the upper thread is evacuated by being hooked by the thread hook member 54 as noted above so that the cut upper thread is not cut again by the cutter device S1.

As the slip plate 31 further lowers from the position of FIG. 12, the base member 34' further pivots toward the cutting position, and the drive lever 51 starts pivoting about the pin 52 in the counterclockwise direction of FIG. 12 while the knife base 40' rotates in the clockwise direction of FIG. 12 about the support pin 41. In response to such rotating movement of the knife base 40', the sewing material T is hooked on the upper surface of the hook section 40*c*. Once the base member 34' pivots to the cutting position of FIG. 13, the knife base 40' rotates to a position where the cutting knife 47 crosses the fixed knife 39. The sewing material T is cut by the cutting knife 47 and the fixed knife 39 crossing each other with the sewing material T hooked on the upper surface of the hook section 40*c*. Then, the sewing material T is retained in the same manner as in the first embodiment at the time of cutting, and new sewing operation is started with an end portion of the sewing material T retained.

In the second embodiment, the knife base 40' rotates via the drive lever 51, and thus, the knife base 40' rotates by a great amount as compared to the pivoting movement of the base member 34'. Thus, the rotation of the knife base 40' is started when the hook section 40*c* of the knife base 40' has reached beneath the sewing material T, so that the sewing material T can be reliably hooked by the hook section 40*c*.

Whereas the thread hook member 54 is provided in the second embodiment, the thread hook member 54 need not be provided if the upper thread too is cut by the cutter device S1 as in the first embodiment. Where the thread hook member 54 is not be provided like this, the presser foot 7 may be fixed to a lower portion of the presser foot support 6 as in the first embodiment, although the presser foot 7 need not necessarily be provided.

According to the present invention, as described above, sewing of the sewing material T is started with an end portion of the sewing material T retained by the retention mechanism (retaining portion 49*a* and knife fixing section 34*a*), and thus, the sewing material T can be reliably sewn onto the sewing workpiece. As a consequence, operation for pulling out the sewing material T prior to the start of the sewing is unnecessary, and it is possible to minimize an unsewn portion of the sewing material T preceding the sewing start point; namely, the unsewn portion of the sewing material T preceding the sewing start point can be of an extremely small amount. Thus, there is no need to cut off the unsewn portion of the sewing material T preceding the sewing start point, which can advantageously avoid wasting the sewing material T.

Further, with the above-described arrangements of the present invention, the human operator has to perform neither the operation for cutting, after completion of sewing, the sewing material T at the cutting position nor the operation for cutting an unsewn portion of the sewing material T preceding the sewing start point. Thus, it is possible to reduce a burden on the human operator. In this way, the present invention can achieve a significantly enhanced operating efficiency, particularly in a multi-head sewing machine.

Furthermore, because the retention, by the retention mechanism, of the sewing material T is realized in response to activation of the sewing material cutting operation by the cutter device S or S1, the present invention can eliminate a need for providing a separate drive source for driving the retention mechanism.

With the operating efficiency enhanced by the present invention, the present invention allows the sewing material cutting step to be performed during the time the sewing material T is being sewn onto a fabric; with the conventionally-known technique, cutting of a swing material is not performed during the time the sewing material T is being sewn onto a fabric.

By the sewing material cutting step allowed to be performed during the time the sewing material T is being sewn onto a fabric as noted above, it is possible to, for example, change a sewing direction and position, in which the sewing material T should be sewn onto the fabric, by cutting the sewing material T during the course of the sewing. Also, in a case where the sewing material T is to be sewn onto the fabric in layers, the sewing material T can be cut each time sewing of a layer is completed.

Note that, after the sewing material T is cut during the course of the sewing as noted above, the sewing may be restarted with the cutter device S or S1 left in the cutting position, in other words, with an end portion of the sewing material T retained by the retention mechanism (retaining portion 49*a* and knife fixing section 34*a*) of the cutter device S or S1. After cutting of the sewing material T immediately following completion of all desired sewing of the sewing material T onto the fabric, the cutter device S or S1 may be returned to the evacuation to facilitate operation for replacing the fabric with another one.

Whereas the embodiments have been described above in relation to the case where the air cylinder 28 that vertically moves the slip plate 31 is employed as the drive source for activating the cutting operation by the cutter device S or S1 and sewing material retaining operation by the retention mechanism, the drive source is not limited to the air cylinder 28 and may be implemented by any other desired actuator, such as a pulse motor.

Furthermore, whereas the embodiments have been described above as sewing the sewing material T by zigzag sewing, the present invention is not so limited, and any other forms of lock stitch sewing may be employed for sewing the sewing material T.

Furthermore, the embodiments have been described above in relation to the case where the retention mechanism (i.e., construction for sandwiching the sewing material T by means of the retaining portion 49*a* and knife fixing section 34*a*) is incorporated in the cutter device S or S1. In an alternative, the sewing machine of the present invention may be modified in such a manner that the cutter device S or S1 has only the function of the retention mechanism. For example, the cutting knife 47 and the fixed knife 39 may be dispensed with in the cutter device S or S1. In this case, there may be separately provided a suitable cutter device for cutting the sewing material T retained by the retention mechanism (cutter device S or S1). In another alternative, cutting of the sewing material T may be performed manually. However, the construction where the retention mechanism (i.e., construction for sandwiching the sewing material T by means of the retaining portion 49*a* and knife fixing section 34*a*) as in the above-described embodiments is advantageous in that the sewing material cutting and retention can be controlled by a common or same drive source and mechanisms.

This application is based on, and claims priority to JP PA 2010-096188 filed on 19 Apr. 2010. The disclosure of the priority application, in its entirety, including the drawings, claims, and the specification thereof, is incorporated herein by reference.

What is claimed is:

1. A sewing machine comprising:

a vertically-driven needle bar;

a sewing needle mounted to a lower end portion of the needle bar;

a rotary member provided coaxially with the needle bar and freely rotatable about an axis of the needle bar;

a guide mounted to the rotary member for guiding a sewing material to a needle drop position of the sewing needle;

a motor for controlling rotation of the rotary member, in accordance with a moving direction of a sewing workpiece based on embroidery data, to thereby change an orientation of the guide in such a manner as to optimize a direction in which the sewing material is to be guided to the needle drop position; and a retention mechanism for retaining an end portion of the sewing material, having been guided by said guide, at a position opposed to said guide with the sewing needle interposed between the retention mechanism and the guide, said retention mechanism comprising a pair of sandwiching members for sandwiching the end portion of the sewing material, said retention mechanism being capable of pivoting between an evacuation position at which the pair of sandwiching members is remote from the sewing needle and a retaining position at which the pair of sandwiching members is close to the sewing needle, said pair of sandwiching members being configured to sandwich the end portion of the sewing material at the retaining position, wherein sewing of the sewing material onto the sewing workpiece is started with the end portion of the sewing material retained by said retention mechanism with the pair of sandwiching members at the retaining position, and then, retention, by said retention mechanism, of the end portion of the sewing material is canceled.

2. The sewing machine as claimed in claim 1, wherein said retention mechanism is mounted to the rotary member and rotatable about the axis of the needle bar together with the rotary member.

3. The sewing machine as claimed in claim 1, further comprising a drive device for controlling a sewing-material sandwiching operation and releasing operation by driving at least one of the sandwiching members.

4. The sewing machine as claimed in claim 3, further comprising a cutter device mounted to a side of the rotary member opposed to the guide in such a manner that the cutter device is rotatable together with the rotary member, said cutter device cutting the sewing material having been paid out from the guide, wherein, before cutting the sewing material via said cutter device upon completion of a sewing operation, said drive device performs the sewing-material sandwiching operation to cause the end portion of the sewing material to be retained by said retention mechanism, and wherein, upon start of a next sewing operation, said drive device performs the sandwiching-canceling operation to cancel retention, by said retention mechanism, of the end portion of the sewing material.

5. A sewing machine comprising:

a vertically-driven needle bar;

a sewing needle mounted to a lower end portion of the needle bar;

a rotary member provided coaxially with the needle bar and freely rotatable about an axis of the needle bar;

a guide mounted to the rotary member for guiding a sewing material to a needle drop position of the sewing needle;

a motor for controlling rotation of the rotary member, in accordance with a moving direction of a sewing workpiece based on embroidery data, to thereby change an orientation of the guide in such a manner as to optimize a direction in which the sewing material is to be guided to the needle drop position;

a retention mechanism for retaining an end portion of the sewing material, having been guided by said guide, at a position opposed to said guide with the sewing needle interposed between the retention mechanism and the guide, wherein sewing of the sewing material onto the sewing workpiece is started with the end portion of the sewing material retained by said retention mechanism, and then, retention, by said retention mechanism, of the end portion of the sewing material is canceled; and a cutter device mounted to a side of the rotary member opposed to the guide in such a manner that the cutter device is rotatable together with the rotary member, said cutter device cutting the sewing material having been paid out from the guide, wherein said retention mechanism is disposed so as to retain the end portion of the sewing material at a position closer to the guide than said cutter device and in interlocked relation to a cutting operation by said cutter device.

6. The sewing machine as claimed in claim 5, wherein said retention mechanism is incorporated in said cutter device.

7. The sewing machine as claimed in claim 5, said cutter device is constructed to cut the sewing material together with an upper thread passed through the sewing needle.

8. The sewing machine as claimed in claim 5, further comprising a thread hook member for hooking thereon an upper thread passed through the sewing needle in interlocked relation to a cutting operation of the cutter device so that the thread hook member prevents the cutter device cutting the upper thread by hooking thereon the upper thread.

9. A sewing machine comprising:

a vertically-driven needle bar;

a sewing needle mounted to a lower end portion of the needle bar;

a rotary member provided coaxially with the needle bar and freely rotatable about an axis of the needle bar;

a guide mounted to the rotary member for guiding a sewing material to a needle drop position of the sewing needle;

a motor for controlling rotation of the rotary member, in accordance with a moving direction of a sewing workpiece based on embroidery data, to thereby change an orientation of the guide in such a manner as to optimize a direction in which the sewing material is to be guided to the needle drop position;

a cutter device mounted to a side of the rotary member opposed to the guide in such a manner that the cutter device is rotatable together with the rotary member, said cutter device cutting the sewing material, having been paid out from the guide, at a predetermined cutting position; and a retention mechanism incorporated in said cutter device for retaining an end portion of the sewing material at a position closer to the guide than the predetermined cutting position and in interlocked relation to cutting, by said cutter device, of the sewing material.

* * * * *